US007513065B2

(12) United States Patent
Kita et al.

(10) Patent No.: US 7,513,065 B2
(45) Date of Patent: Apr. 7, 2009

(54) SOLE STRUCTURE FOR A SHOE

(75) Inventors: Kenjiro Kita, Ikoma-gun (JP); Akihiro Miyauchi, Kawanishi (JP); Koji Ito, Takaishi (JP)

(73) Assignee: Mizuno Corporation, Osaka-shi (JP)

( * ) Notice: Subject to any disclaimer, the term of this patent is extended or adjusted under 35 U.S.C. 154(b) by 259 days.

(21) Appl. No.: 11/317,321

(22) Filed: Dec. 22, 2005

(65) Prior Publication Data

US 2006/0137227 A1 Jun. 29, 2006

(30) Foreign Application Priority Data

Dec. 27, 2004 (JP) ..... 2004-375190

(51) Int. Cl.
*A43B 13/28* (2006.01)
*A43B 13/18* (2006.01)

(52) U.S. Cl. ..... 36/27; 36/28

(58) Field of Classification Search ..... 36/27, 36/28, 30 R, 35 R, 29
See application file for complete search history.

(56) References Cited

U.S. PATENT DOCUMENTS 6,463,680 B1 * 10/2002 Myers ..... 36/28
6,523,280 B1 * 2/2003 Lapointe ..... 36/7.8
6,625,905 B2 9/2003 Kita
6,826,852 B2 * 12/2004 Fusco ..... 36/103
2004/0049946 A1 * 3/2004 Lucas et al. ..... 36/28
2006/0265902 A1 11/2006 Kita et al.
2006/0283045 A1 12/2006 Kita et al.

FOREIGN PATENT DOCUMENTS

JP 2003-339405 12/2003

* cited by examiner

*Primary Examiner*—Ted Kavanaugh
(74) *Attorney, Agent, or Firm*—W. F. Fasse; W. G. Fasse

(57) ABSTRACT

A sole structure is provided that can improve bendability and cushioning ability of the sole forefoot portion. The sole assembly 1 is formed of an upper plate 2, and a lower plate 3 provided below the upper plate 2 and spaced apart from the upper plate 2 via a void S. The lower plate 3 has a plurality of protrusions 30 that protrude toward the upper plate 2. The longitudinal path length $L_1$ of the lower plate 3 is longer than the longitudinal path length $L_2$ of the upper plate 2. More specifically, the path length $L_1$ of the lower plate 3 is 40-60% longer than the path length $L_2$ of the upper plate 2.

32 Claims, 12 Drawing Sheets

SOLE STRUCTURE FOR A SHOE

BACKGROUND OF THE INVENTION

The present invention relates generally to a sole structure for a shoe, and more particularly, to an improvement in the sole structure for enhancing cushioning properties and bendability of the forefoot portion of the sole.

Japanese patent application laying-open publication No. 2003-339405 shows a sole structure for a shoe to secure cushioning properties and improve bendability. The sole structure shown in this publication has a structure in which an upper plate and a lower plate are disposed on the upper side and the lower side, respectively, of a wavy plate that extends from the heel region to the forefoot region.

In this case, a plurality of voids formed between the wavy plate and the upper and lower plate provide cushioning properties. Also, in this case, the wavy plate has a two-layered shank portion of a spindle shape in the sole midfoot portion. Such a shank portion restrains bending deformation of the sole midfoot portion, thus improving the bendability of the sole forefoot portion.

However, in the prior art structure, the sole forefoot portion also has a three-layered plate structure. During bending of the sole forefoot portion, the lower plate acts to restrict expansion and contraction of the wavy plate in the longitudinal direction. Therefore, it was difficult to fully enhance the bendability of the sole forefoot portion. Similarly, since the lower plate restricts deformation of the voids, it was also difficult to fully enhance the cushioning properties of the sole forefoot portion.

An object of the present invention is to provide a sole structure for a shoe that can improve bendability and cushioning properties of the sole forefoot portion.

SUMMARY OF THE INVENTION

A sole structure for a shoe according to the present invention includes an upper plate disposed on the upper side of the forefoot region of the sole structure, and a lower plate disposed on the lower side of the forefoot region and having a void relative to the upper plate. The length of the path of the lower plate in the longitudinal direction is longer than the length of the path of the upper plate in the longitudinal direction.

According to the present invention, during bending deformation of the sole forefoot portion, the lower plate having a longer longitudinal path than the upper plate does not hinder the bending deformation of the sole forefoot portion, thereby increasing the bendability of the sole forefoot portion.

To the contrary, in the case where the length of the path of the lower plate in the longitudinal direction is shorter than or equal to the length of the path of the upper plate in the longitudinal direction, during bending deformation of the sole forefoot portion, the lower plate restricts the deformation of the upper plate, thus hindering the bendability of the sole forefoot portion.

Moreover, according to the present invention, deformation of the voids formed between the upper and lower plate is not impeded, thereby enhancing cushioning properties of the sole forefoot portion.

Preferably, the upper plate is generally flat at the forefoot region. In this case, the flat upper plate restrains a pressure exerted from the ball of the foot of a shoe wearer on the upper plate from being absorbed by deformation of the upper plate. As a result, deformation of the lower plate can be effectively promoted during bending deformation of the sole forefoot portion. Also, in this case, a foot contact feeling of the shoe wearer becomes favorable.

The lower plate may have one or two or more convex or concave portions. Alternatively, the lower plate may have a plurality of convex portions protruding toward the upper plate. In these cases, during bending deformation of the sole forefoot portion, the convex or concave portions of the lower plate deform to a flatter shape to extend the lower plate in the longitudinal direction.

Also, the lower plate may have a plurality of convex portions protruding toward the upper plate and extending along the width of the lower plate, and the height of the convex portion on the medial side of the lower plate may be higher than the height of the convex portion on the lateral side of the lower plate. In this case, the convex portion on the medial side can effectively prevent pronation of a foot at the time of striking onto the ground, thereby achieving a sole structure suitable for running.

In contrast, the lower plate may have a plurality of convex portions protruding toward the upper plate and extending along the width of the lower plate, and the height of the convex portion on the lateral side of the lower plate may be higher than the height of the convex portion on the medial side of the lower plate. In this case, the convex portion on the lateral side can effectively prevent supination of a foot at the time of striking onto the ground, thereby achieving a sole structure suitable for indoor sports such as tennis, basketball and the like.

The length of the path of the lower plate in the longitudinal direction is preferably at least 40%, more preferably 40-60%, longer than the length of the path of the upper plate in the longitudinal direction.

The upper and lower plate is preferably formed of hard plastic resin to prevent the voids between the upper and lower plate from being easily crushed, thus improving the cushioning properties of the sole forefoot portion.

On the bottom surface of the lower plate may be directly (i.e. without a midsole) or indirectly (i.e. with a midsole) provided an outsole that contacts the ground. Alternatively, the bottom surface of the lower plate may directly constitute a ground contact surface.

The midsole or the outsole may be formed with a groove extending substantially in the lateral or width direction. In this case, the bendability of the sole forefoot portion can be further improved.

Between the upper and lower plate may be formed one or two or more cushion bars extending substantially along the width direction. In this case, provision of the cushion bars not only controls the bendability and the cushioning properties of the sole forefoot portion but also controls the bending position of the sole forefoot portion.

The cushion bar is preferably formed of a lower elastic material than the upper and lower plate. That is, the Young's modulus of elasticity of the cushion bar is smaller than that of the upper and lower plate.

The lower plate may be formed with a longitudinally extending indentation, groove, concave, or elongated aperture. In this case, the medial side portion and the lateral side portion of the lower plate that are separated at the indentation, groove, concave, or elongated aperture can deform downwardly independently from the other side portion, thus improving the bendability of the sole forefoot portion in the width direction. In this case, a sole structure suitable for indoor sports such as tennis, basketball or the like that require side steps can be achieved. Furthermore, in this case, when a plurality of laterally extending convex portions are provided on the lower plate and the height of the convex portion on the lateral side is made higher than the convex portion on the medial side, supination of the foot on striking onto the ground can be further effectively prevented and the sole structure more suitable for indoor sports can be achieved.

The upper plate may be formed with a plurality of vent holes extending through the upper plate in the vertical direction. In this case, since there are provided voids between the upper and lower plate, the air can be easily and immediately introduced into the inside of the shoe from the vent holes through the voids.

The lower plate may have a plurality of cleats or studs provided on the lower surface thereof. In this case, a cleated shoe that can increase bendability and cushioning properties of the sole forefoot portion is achieved. Moreover, in this case, since the upper plate is located away from the lower plate via the void, the upper plate can deform curvedly in a smooth manner without being influenced by the bending state of the lower plate, which is determined by the positions of the cleats on the lower plate during bending of the sole forefoot portion. Thereby, a foot contact feeling during bending of the sole forefoot portion can be enhanced. Moreover, in this case, since a pressure by the cleats from below at the time of striking onto the ground is not directly transmitted to the upper plate, a sense of pressure felt by the shoe wearer can be relieved.

There may be provided a cushion pad at a position corresponding to the cleat between the upper plate and the lower plate. In this case, the cushion pad can absorb and relieve the pressure applied by the cleat from below to the sole.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1A:
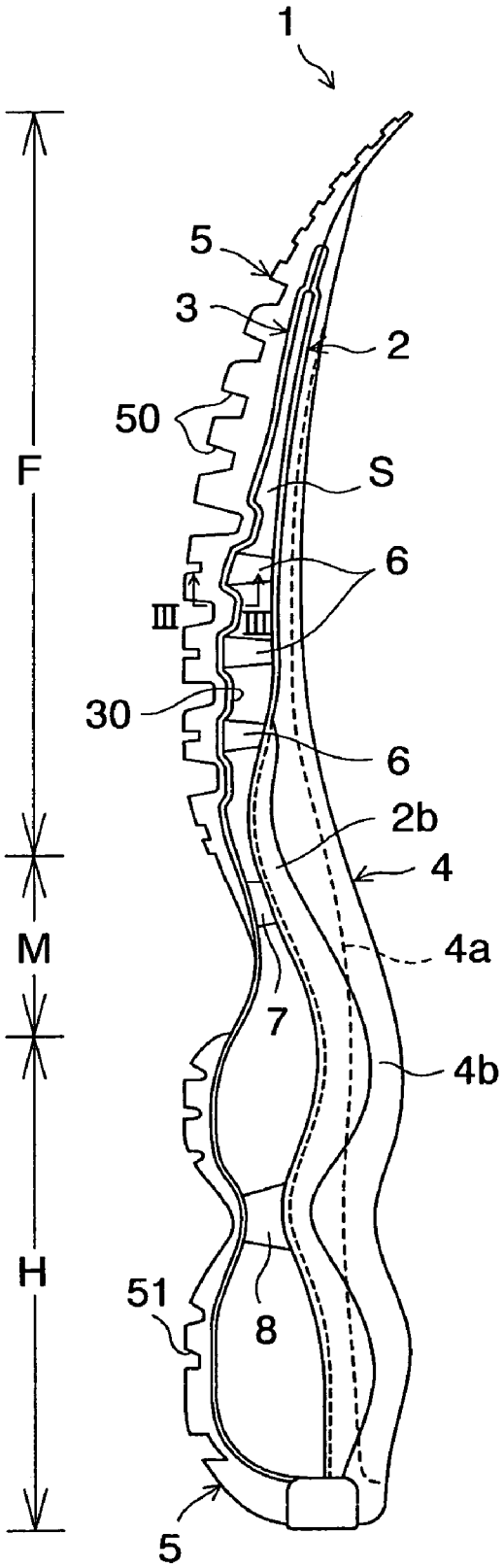
FIG. 1A is a side view on the lateral side of a sole structure according to a first embodiment of the present invention.
Figure 1B:
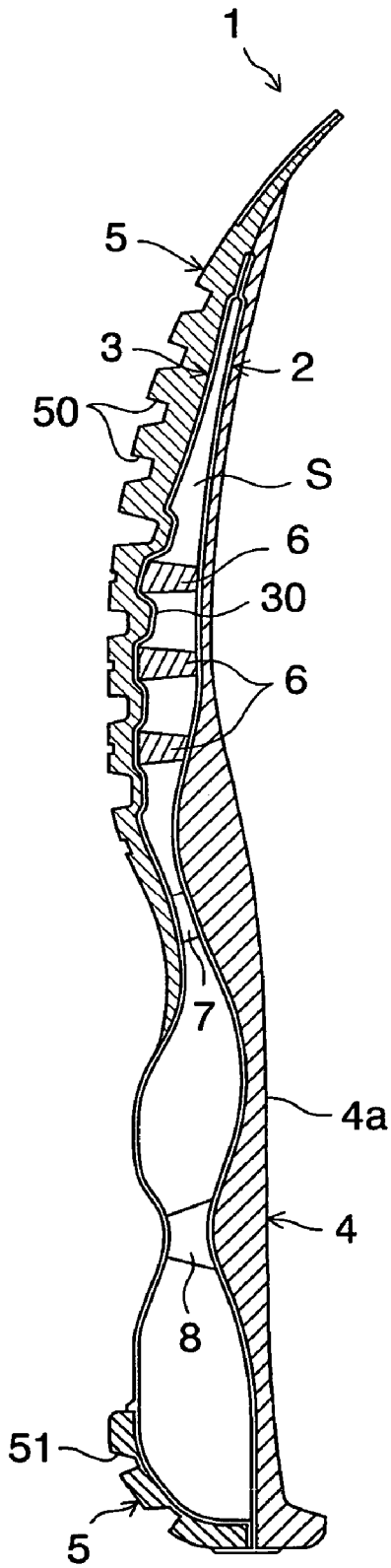
FIG. 1B is a longitudinal sectional view of the sole structure of FIG. 1A taken along the longitudinal centerline.

Referring now to the drawings, FIGS. 1A and 1B show a sole structure according to a first embodiment of the present invention. The sole structure 1 for a shoe includes an upper plate 2 extending from the heel portion H through the midfoot portion M to the forefoot portion F, and a lower plate 3 disposed below the upper plate 2 and extending from the heel portion H through the midfoot portion M to the forefoot portion F. A void S is formed between the upper plate 2 and the lower plate 3. The upper and lower plate 2, 3 extend in the shoe width direction (or into the page of FIG. 1A) as well.

Above the upper plate 2 is provided a midsole 4 formed of a soft elastic material and extending from the heel portion H through the midfoot portion M to the forefoot portion F. The upper plate 2 is fixedly attached to the bottom surface of the midsole 4. The midsole 4 has a foot contact surface 4*a* that contacts the sole of a shoe wearer's foot and an upraised portion 4*b* formed at opposite side edges of the foot contact surface 4*a*. The upraised portion 4*b* is adapted to be fixedly attached to the bottom portion of a shoe upper (not shown).

On the bottom surface of the lower plate 3 is fixedly attached an outsole 5. The outsole 5 is formed with a plurality of grooves 50, 51 extending substantially in the shoe width direction. The groove 50 formed in the forefoot portion F provides a bending function in addition to a slip-preventive function of the sole structure 1. The groove 51 formed in the heel portion H mainly provides a slip-preventive function of the sole structure 1.

In the greater part of the forefoot portion F, the upper plate 2 extends linearly or slightly curved downwardly in the rearward direction. From the rear end region of the forefoot portion F to the midfoot portion M, the upper plate 2 curves downwardly convexedly. In the central region of the heel portion H as well, the upper plate 2 curves downwardly convexedly. In other words, the upper plate 2 has a wavy shape in the region from the midfoot portion M to the heel portion H. On opposite side edges of the upper plate 2 are formed a pair of upraised portions 2*b*. The upraised portion 2*b* is in contact with the outside surface of the corresponding upraised portion 4*b* of the midsole 4.

The lower plate 3 extends generally parallel to the upper plate 2 in the front region of the forefoot portion F. From the central region to the rear region of the forefoot portion F, the lower plate 3 has a plurality of convex portions 30 protruding toward the upper plate 2 and curves slightly downwardly. FIGS. 1A and 1B show a trapezoidal shaped convex portion 30, but the convex portion 30 may be rectangular, circular, or triangular shaped in cross section. The lower plate 3 curves upwardly convexedly in the midfoot portion M. In the central region of the heel portion H as well, the lower plate 3 curves upwardly convexedly. In other words, the lower plate 3 has a wavy shape in the region from the midfoot portion M to the heel portion H.

In the example shown in FIGS. 1A and 1B, the lower plate 3 has four convex portions 30, but the number of the convex portions 30 is not limited to this example. The number of the convex portions 30 may be one or two or more than two. In lieu of the convex portion 30, one or two or more than two concave portions may be provided. Alternatively, wavy corrugations may be provided.

Figure 3A:
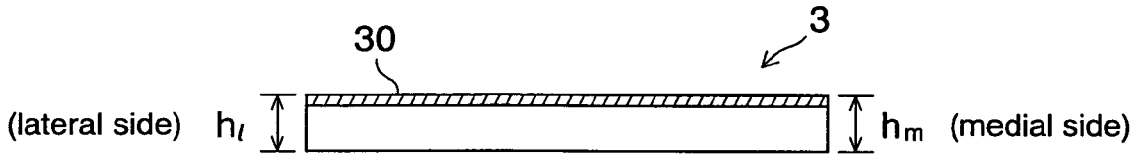
FIG. 3A is a cross sectional view of FIG. 1A taken along line III-III.
Figure 3B:
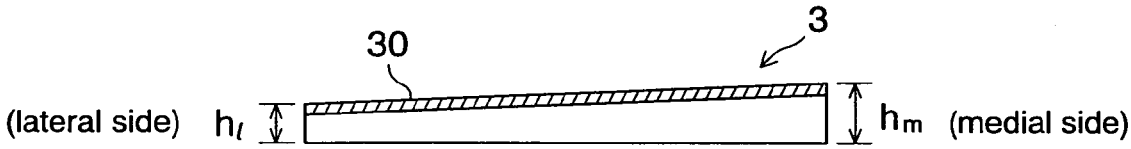
FIG. 3B is an alternative embodiment of FIG. 3A.
Figure 3C:
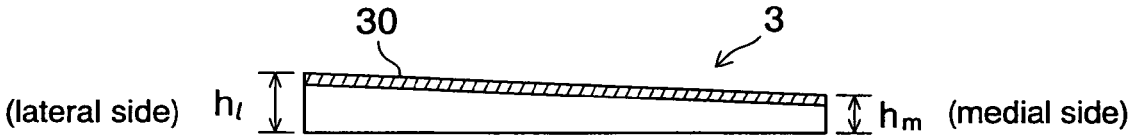
FIG. 3C is a second alternative embodiment of FIG. 3A.

Preferably, the convex portion 30 is formed of a convexedly extending portion that extends substantially in the shoe width direction. As shown in FIG. 3A illustrating a cross sectional view of FIG. 1A taken along line III-III, the height of the convexedly extending portion 30 may be equal to each other between the medial side and the lateral side (i.e. $h_m=h_l$). Alternatively, as shown in FIGS. 3B and 3C, the height of the convexedly extending portion 30 on the medial side may be greater or smaller than the height of the convexedly extending portion 30 on the lateral side (i.e. $h_m>h_l$ or $h_m<h_l$).

In the case of $h_m>h_l$, because the rigidity of the medial portion is higher than the rigidity of the lateral portion and when the upper plate that has been deformed contacts the convex portion of the lower plate a further deformation of the upper plate is restricted by the convex portion of the lower plate, the convexedly extending portion 30 on the medial side can effectively prevent pronation at the time of striking onto the ground, thus achieving a sole structure suitable for sports such as running.

On the other hand, in the case of $h_l>h_m$, because the rigidity of the lateral portion is higher than the rigidity of the medial portion and when the upper plate that has been deformed contacts the convex portion of the lower plate a further deformation of the upper plate is restricted by the convex portion of the lower plate, the convexedly extending portion 30 on the lateral side can effectively prevent supination at the time of striking onto the ground, thus achieving a sole structure suitable for indoor sports such as tennis, basketball or the like.

In the void S between the upper plate 2 and the lower plate 3 are provided a plurality of cushion bars 6, 7, and 8. The cushion bar 6 is disposed between the longitudinally adjacent convex portions 30 on the lower plate 3 in the forefoot portion F. The cushion bar 7 is disposed at a position where the upper and lower plates 2, 3 are close to each other in the midfoot portion M. Similarly, the cushion bar 8 is disposed at a position where the upper and lower plates 2, 3 are close to each other in the heel portion H. Each of the cushion bars 6, 7, and 8 extends substantially in the shoe width direction. In this example, the cushion bar 6 extends along the entire width of the sole structure, and each of the cushion bars 7, 8 is formed of a pair of members disposed at opposite side ends of the sole structure (see FIG. 1B).

A longitudinal path length $L_1$ of the lower plate 3 in the forefoot portion F is longer than a longitudinal path length $L_2$ of the upper plate 2. Here, the "path length" means a length measured along the configuration of the plate 2, 3.

In the example shown in FIGS. 1A and 1B, the path length $L_1$, $L_2$ is a length along the configuration of the upper and lower plate 2, 3 that is measured from a coupled portion of the upper and lower plate 2, 3 in the front region of the forefoot portion F to the end portion of the upper and lower plate 2, 3 corresponding to the terminal of the forefoot portion F.

Preferably, the longitudinal path length $L_1$ of the lower plate 3 is at least 40% longer than the longitudinal path length $L_2$ of the upper plate 2. More preferably, the longitudinal path length $L_1$ of the lower plate 3 is 40-60% longer than the longitudinal path length $L_2$ of the upper plate 2.

Figure 4:
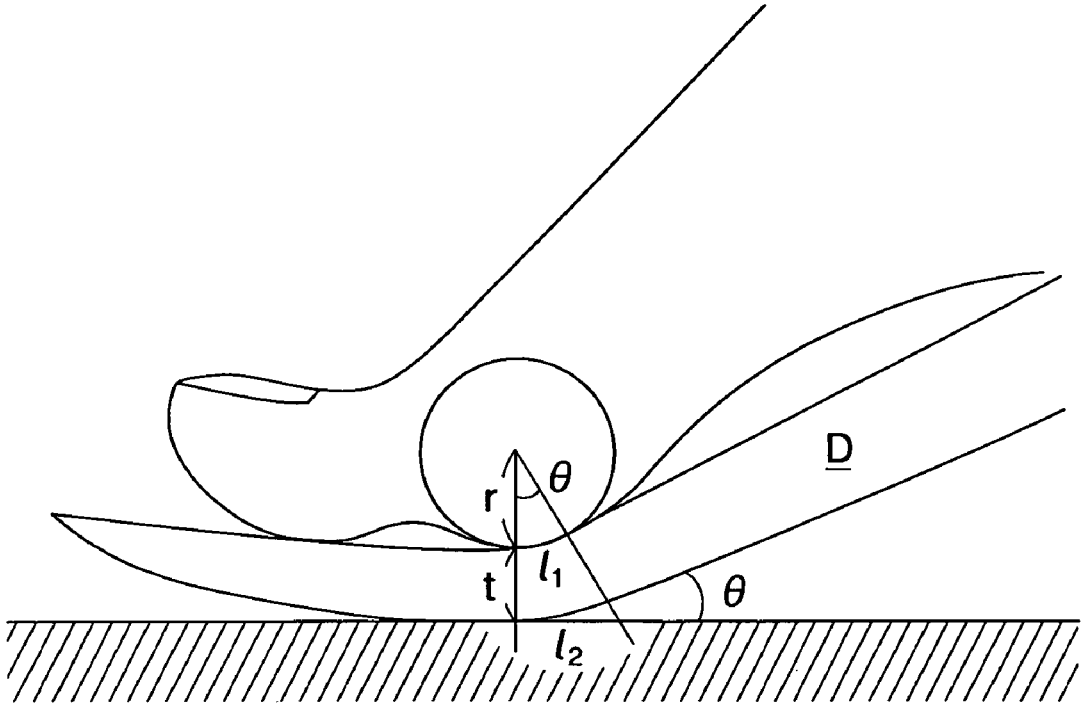
FIG. 4 is a schematic view showing the state where a shoe wearer's foot is bent an angle of θ.

The basis for these numerical values is as follows:

FIG. 4 shows the state where a shoe wearer's foot and a shoe sole D are bent at an angle of θ. In FIG. 4, "r" represents a radius of curvature of a thenar eminence of the foot and "t" represents a thickness of the sole forefoot portion. Here, in order to include individual differences between adults and/or children, "r" and "t" are set to satisfy the following inequality:

$$12 \leqq r \leqq 22 \text{ (mm) and } 5 \leqq t \leqq 13 \text{ (mm)}$$

Also, angle θ is set at 30 degrees in order to effectively develop a "rolling-up action" at the time of bending of the foot. Here, the "rolling-up action" is a phenomenon where tension in the plantar aponeurosis and plantar fascia increases at the time of bending of the foot and a force occurs to return the portion in front of the metatarsophalangeal joint to generate a kick power against the ground. In the light of the structure of the foot, such "rolling-up action" becomes remarkable when the bending angle θ of the foot is more than 30 degrees. The bending angle θ is determined by the angle formed between the line connecting the tip end of the toe with the rear end of the toe and the line connecting the distal end of the metatarsus with the proximal end of the calcaneus at the time of bending of the toe.

At this juncture, $l_1$ is the length of a substantially circular arc portion on the sole upper surface contacting the thenar eminence portion of the foot, and $l_2$ is the length of a substantially circular arc portion on the sole lower surface corresponding to the substantially circular arc portion on the sole upper surface. $l_1$ and $l_1$ are determined as follows:

$$l_1 = 2\pi r \times (30°/360°) = \pi r/6 \quad (1)$$

$$l_2 = 2\pi(r+t) \times (30°/360°) = \pi(r+t)/6 \quad (2)$$

Wherein $12 \leqq r \leqq 22$ (mm) and $5 \leqq t \leqq 13$ (mm)

Then, by comparing the value of $l_1$ with the value of $l_2$, it will be found that $l_2$ is elongated approximately 40-60% longer than $l_1$.

Judging from the result, when the longitudinal path length $L_1$ of the lower plate 3 has been made at least 40% (preferably 40-60%) longer than the longitudinal path length $L_2$ of the upper plate 2, the lower plate 3 will not hinder the bending motion of the sole forefoot portion during bending of the sole forefoot portion, thereby improving the bendability of the sole forefoot portion.

The upper and lower plate 2, 3 is preferably formed of a hard plastic resin in order to prevent loss of elasticity due to repetitive deformation to maintain the shape of the void S to some degree between the plates 2 and 3. For example, the upper and lower plate 2, 3 may be formed of thermoplastic resin such as thermoplastic polyurethane (TPU), polyamide elastomer (PAE), ABS resin or the like. Alternatively, the upper and lower plate 2, 3 may be formed of thermosetting resin such as epoxy resin, unsaturated polyester resin or the like. Also, the upper and lower plate 2, 3 may be formed of fiber reinforced plastics including carbon fibers or metal fibers.

The midsole 4 is preferably formed of a soft elastic material to contact and support the sole of a shoe wearer. For example, foamed thermoplastic resin such as ethylene-vinyl acetate copolymer (EVA), foamed thermosetting resin such as polyurethane (PU), and foamed rubber such as butadiene rubber or chloroprene rubber may be used.

The cushion bar 6 may be formed of a relatively soft or lower elastic material (e.g. foamed member) to maintain the cushioning properties of the forefoot portion F. On the other hand, the cushion bars 7, 8 may be formed of a relatively hard or higher elastic material (e.g. solid rubber) to avoid contacting of the upper plate 2 with the lower plate 3 at the time of striking onto the ground. In addition, "lower elastic" means having a smaller modulus of elasticity, and "higher elastic" means having a greater modulus of elasticity.

Figure 2:
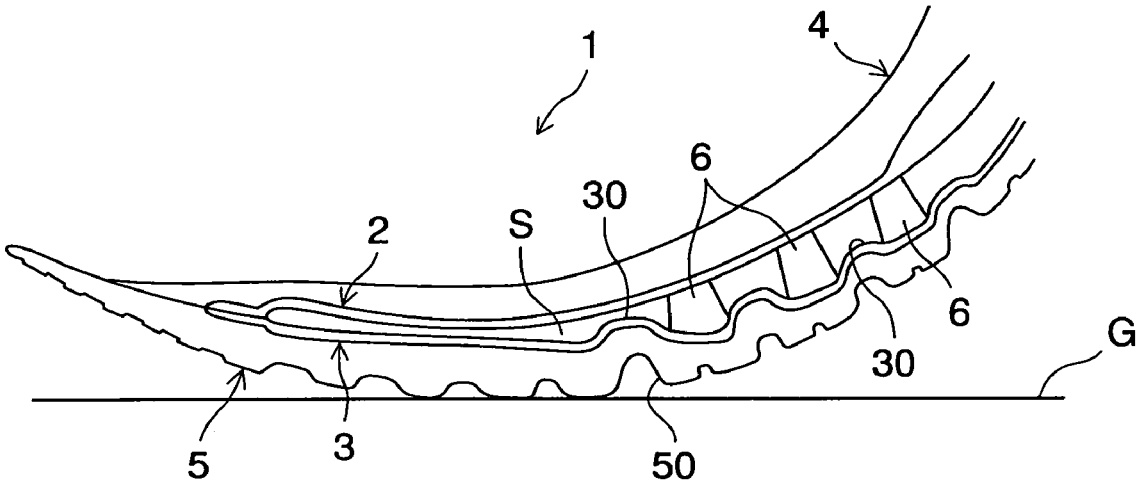
FIG. 2 is a side view illustrating the bending state of the sole forefoot portion of the sole structure according to the first embodiment of the present invention.

As shown in FIG. 2, when the forefoot portion F of the sole structure 1 bends during walking or running, each of the convex portions 30 of the lower plate 3 deforms into a flatter shape and the lower plate 3 thus elongates in the longitudinal direction.

Thereby, during bending deformation of the forefoot portion F, the lower plate 3 will not hinder the bending deformation of the forefoot portion F. As a result, bendability of the forefoot portion F can be improved. Also, in this case, since the lateral grooves 50 are formed on the outsole 5 fitted to the bottom surface of the lower plate 3, the bendability of the forefoot portion F is not impeded by the outsole 5.

In contrast, in the case where the longitudinal path length of the lower plate 3 is shorter than or equal to the longitudinal path length of the upper plate 2, the lower plate 3 acts to restrain the deformation of the upper plate 2 during bending deformation of the forefoot portion F, and the bendability of the forefoot portion F is thus hindered.

Also, according to this embodiment, since the deformation of the void S formed between the upper and lower plate 2, 3 is not prevented by the other member, the void S can deform smoothly at the time of striking onto the ground, thereby improving the cushioning properties of the forefoot portion F. Moreover, in this case, since the upper and lower plate 2, 3 is formed of a hard elastic material, the void S between the upper and lower plate 2, 3 can be prevented from being easily crushed. As a result, cushioning properties of the forefoot portion F can be further enhanced.

Furthermore, by providing the cushion bars 6, bendability and the cushioning properties of the forefoot portion F can be controlled and the bending position of the forefoot portion F can be controlled to a certain degree.

Also, provision of a plurality of convex portions 30 on the lower plate 3 helps prevent lateral deformation of the forefoot portion F at the time of striking onto the ground. Thereby, not only running stability can be improved but also contact areas at the time of kicking the ground surface can be enlarged to improve traction ability.

Figure 5A:
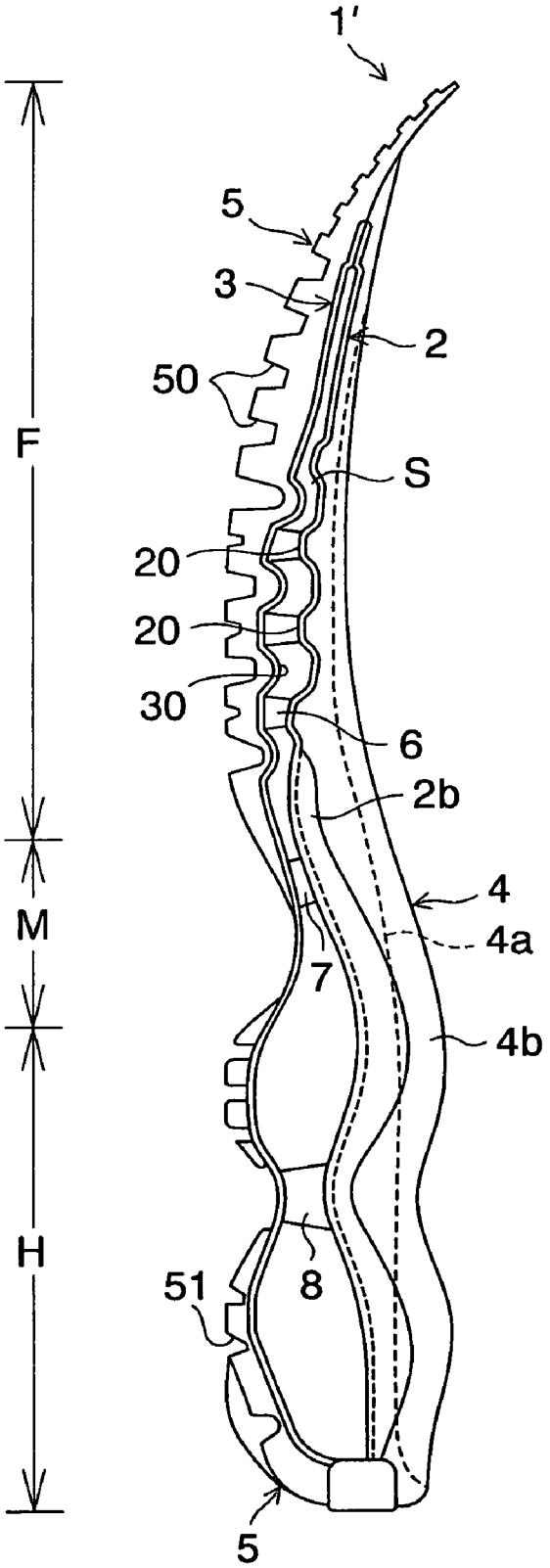
FIG. 5A is a side view on the lateral side of a sole structure according to a second embodiment of the present invention.
Figure 5B:
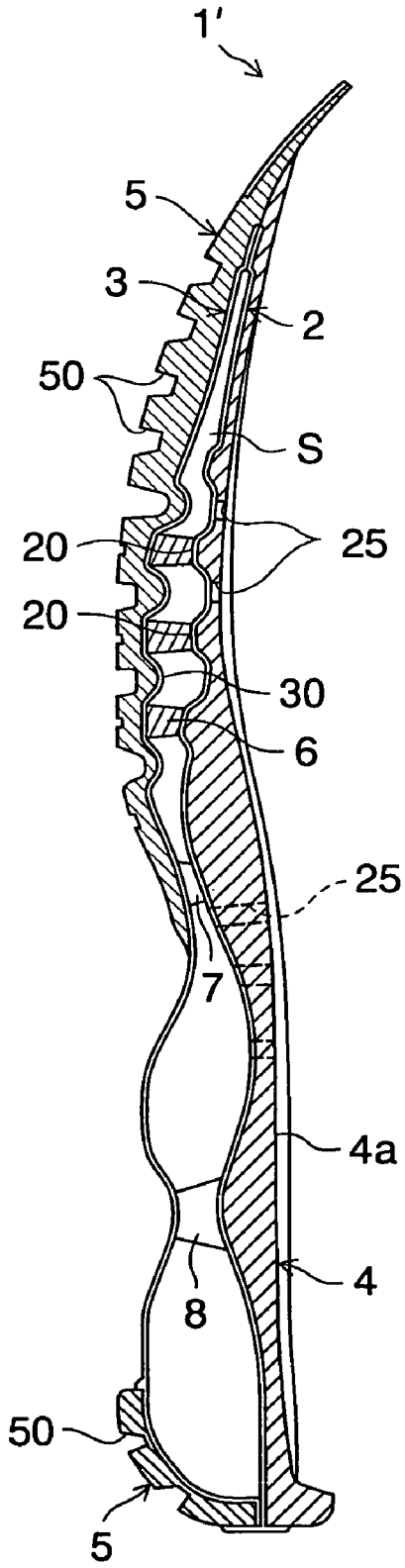
FIG. 5B is a longitudinal sectional view of the sole structure taken along the longitudinal centerline.

FIGS. 5A and 5B show a sole structure according to a second embodiment of the present invention. In these drawings, like reference numbers indicate identical or functionally similar elements.

As with the sole structure 1 of the above-mentioned first embodiment, the sole structure 1' according to the second embodiment has the upper and lower plate 2, 3 extending from the heel portion H to the forefoot portion F and located away from each other via the void S. The sole structure 1' differs from the sole structure 1 in that the upper plate 2 of the sole structure 1' has a plurality of convex portions 20 protruding toward the lower plate 3 in the central region to the rear region of the forefoot portion F. These convex portions 20 protrude toward the position between the longitudinally adjacent convex portions 30 of the lower plate 3.

In the case as well where not only the lower plate 3 but also the upper plate 2 has the convex portions, similar to the first embodiment, the longitudinal path length $L_1$ of the lower plate 3 is longer than the longitudinal path length $L_2$ of the upper plate 2 in the forefoot portion F. Thereby, in the same manner as the first embodiment, the bending deformation of the forefoot portion F is not hindered by the lower plate 3, and the bendability of the forefoot portion F can thus be improved.

In addition, the number of the convex portions 20 is not limited to the example shown in FIGS. 5A and 5B. Also, in lieu of the convex portions, one or more than two concave portions may be provided. Alternatively, wavy convex and concave portions may be formed in the upper plate 2.

Also, the sole structure 1' of the second embodiment differs from the sole structure 1 of the first embodiment in that a plurality of vent holes 25 are formed penetrating vertically through the upper plate 2 and the midsole 4. The lower end of the vent holes 25 opens into the void S formed between the upper plate 2 and the lower plate 3. In this case, the outside air is introduced into the inside of the shoe via the void S between the upper and lower plate 2, 3. Thereby, an easy and fast air introduction can be attained.

Additionally, in the first and second embodiment of the present invention, the outsole 5 contacting the ground surface is directly provided on the bottom surface of the lower plate 3, but the outsole may be provided on the bottom surface of the lower plate 3 via a midsole formed of a soft elastic member interposed therebetween. In this case, when the midsole also has a laterally extending groove formed thereon, a decrease in the bendability of the forefoot portion due to the midsole can be restrained. Alternatively, the bottom surface of the lower plate 3 may directly constitute the ground contact surface by forming the lower plate 3 of a rubber material, specifically a hard solid rubber. In this case, preferably, convex portions are suitably provided on the ground contact surface to improve non-slip properties and durability.

Also, in the first embodiment, each of the cushion bars 6 is located between the longitudinally adjacent convex portions 30 of the lower plate 3, but the cushion bar 6 may be located on the convex portion 30. In this case, similar to the other cushion bars 7, 8, the cushion bar 6 is preferably formed of a comparatively hard member such as solid rubber in order to prevent the upper and lower plate from contacting each other when a shock load is exerted at the time of striking onto the ground.

Figure 6:
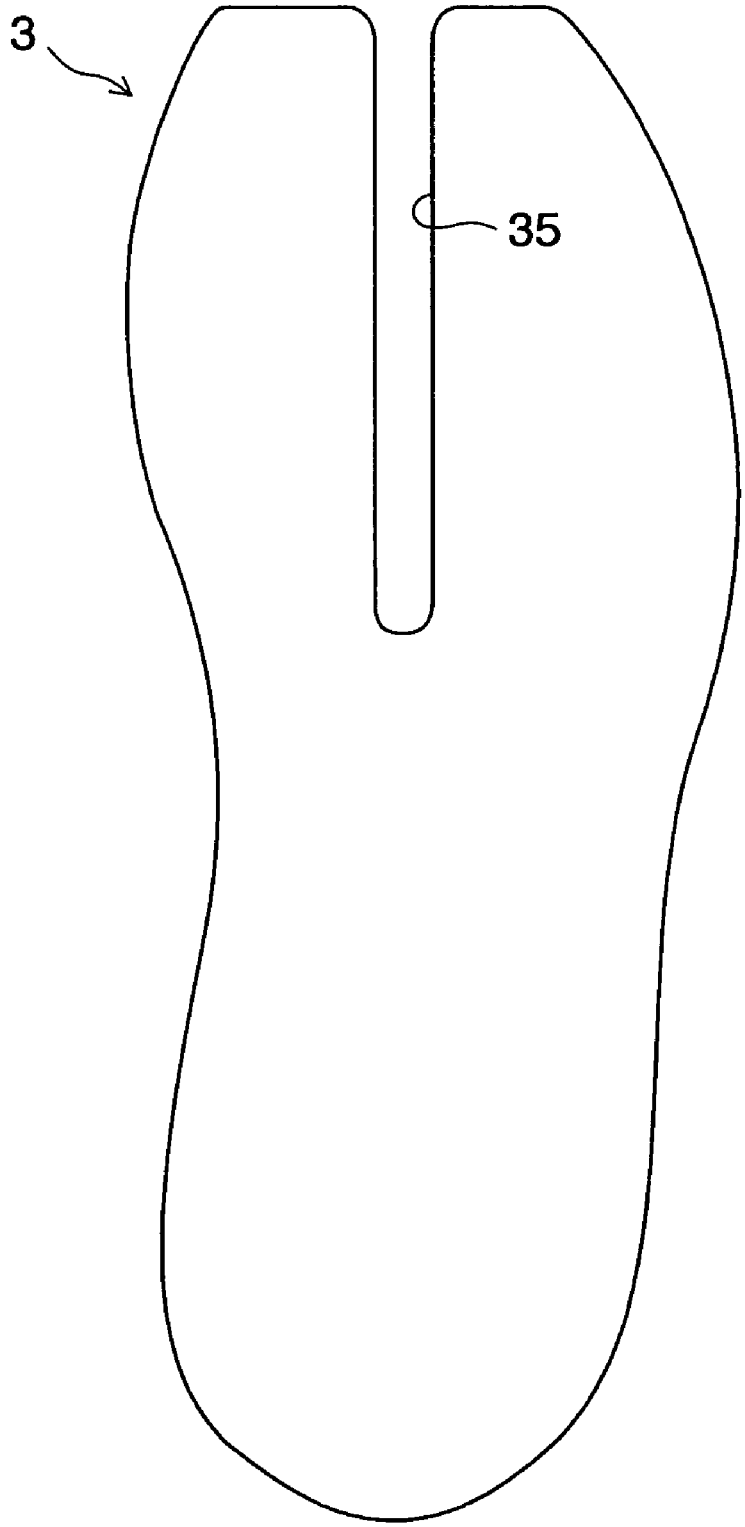
FIG. 6 is a bottom schematic view of a lower plate of a sole structure according to a third embodiment of the present invention.

FIG. 6 shows a lower plate of a third embodiment of the present invention. As shown in FIG. 6, the lower plate 3 has a longitudinally extending indentation 35 formed centrally in the forefoot region.

In this case, the medial and lateral portions of the lower plate 3 disposed on opposite sides of the indentation 35 can deform downwardly independently of the other portion, thus improving the lateral bendability of the sole forefoot portion. In this case, a sole structure can be achieved that is suitable for sports such as tennis, basketball or the like where side steps are required.

The position of the indentation 35 is not limited to the laterally central position of the lower plate 3, and it may be located at the position either closer to the medial side (i.e. the great toe side) or the lateral side (i.e. the little toe side). Also, by properly adjusting the width and number of the indentation 35, the way of deformation of the medial portion and the lateral portion of the lower plate 3 can be adjusted more delicately. Alternatively, a longitudinally extending groove, depression, or elongated aperture (not shown) may be formed in the lower plate 3 in lieu of an indentation. In either case, the medial and lateral portion of the lower plate 3 disposed on opposite sides of the groove, depression, or elongated aperture can deform downwardly independently of the other portion, thus improving the lateral bendability of the sole forefoot portion.

Figure 7A:
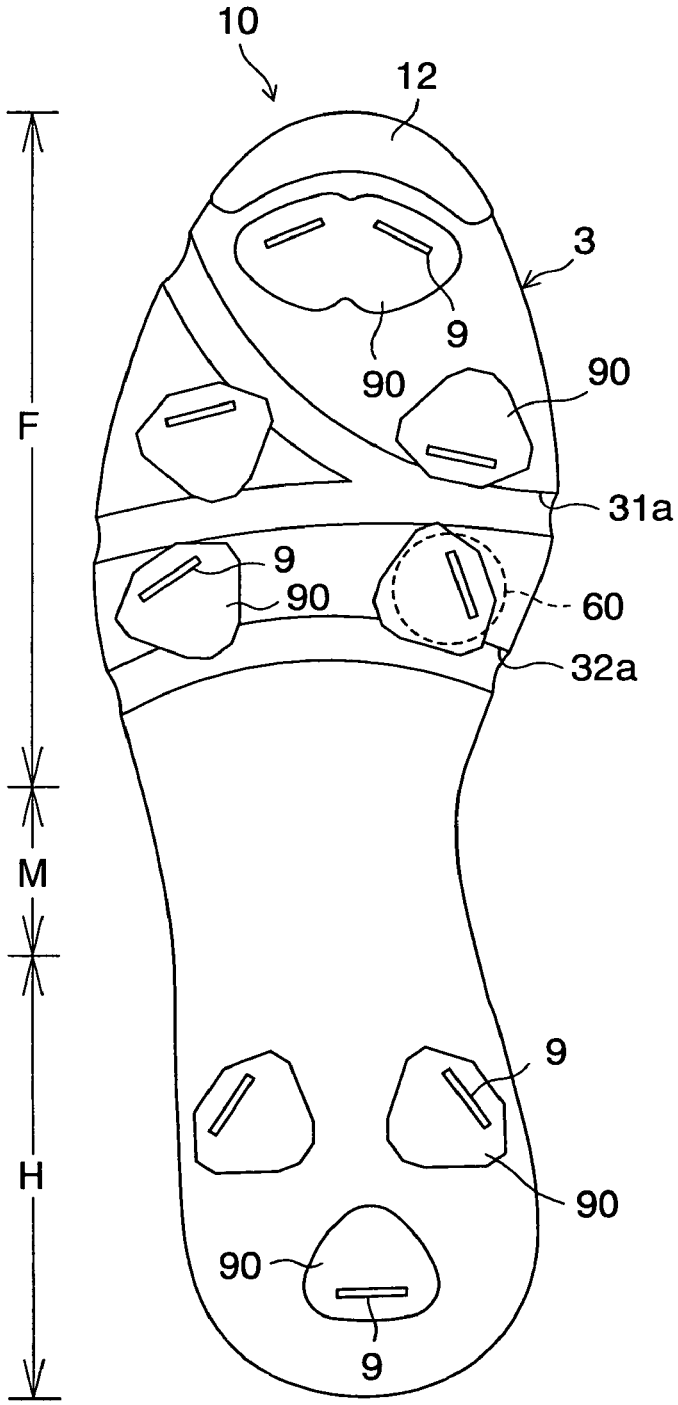
FIG. 7A is a bottom view of a sole structure according to a fourth embodiment of the present invention.
Figure 7B:
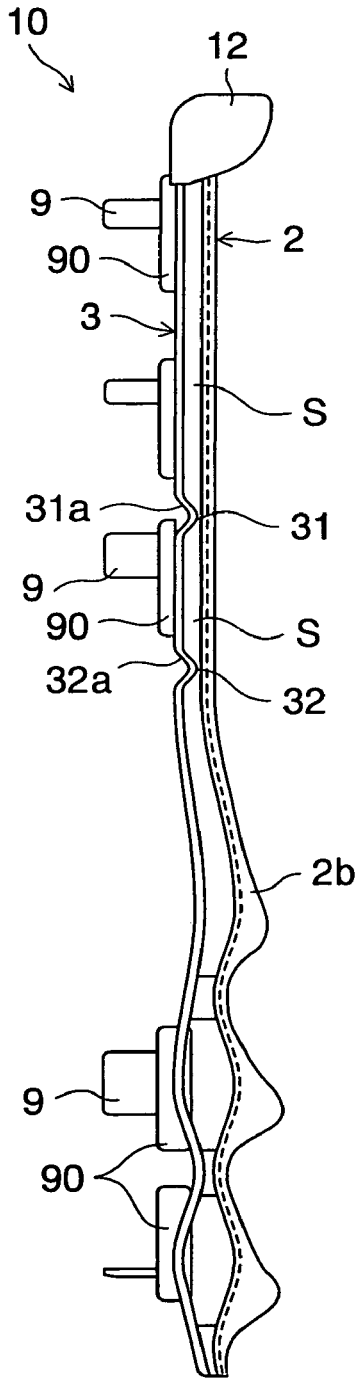
FIG. 7B is a side view on the medial side of the sole structure.

FIGS. 7A and 7B show a sole structure according to a fourth embodiment of the present invention. In these drawings, like reference numbers indicate identical or functionally similar elements. In the fourth embodiment, the sole structure of the present invention is applied to a cleated shoe or spike shoe.

Similar to the sole structure 1, 1' of the first and second embodiment, a sole structure 10 includes an upper and lower plate 2, 3 each extending longitudinally from the heel portion H to the forefoot portion F and spaced apart in the vertical direction via the void S. The upper and lower plates 2, 3 extend substantially parallel to each other in the forefoot portion F. The front end portions of the upper and lower plate 2, 3 are fixedly attached to the toe guard 12. The lower plate 3 has a plurality of convex portions 31, 32 protruding toward the upper plate 2. Here, each of the convex portions 31, 32 is triangular shaped in cross section. Also, the lower or bottom surface of the lower plate 3 is exposed to the bottom side of the sole structure 10 and the bottom side portions of the convex portions 31, 32 are shown as grooves 31*a*, 32*a*, respectively, on the bottom surface of the sole structure 10.

The sole structure 10 greatly differs from the sole structure 1, 1' in that the lower plate 3 has cleats (i.e. spikes or studs) 9 on the lower surface thereof. A plurality of cleats 9 are provided at the forefoot portion F and the heel portion H and fitted to the lower surface of the lower plate 3 through thick mounting portions 90. The mounting portion 90 is disposed at a flat portion of the bottom surface of the lower plate 3 in the forefoot portion F and disposed at a trough portion (i.e. a downwardly convex portion) of wave configurations of the bottom surface of the lower plate 3 in the heel portion H. When the shoe wearer strikes onto the ground on the heel portion H, a pressure applied from the ground contact surface to the cleats 9 can be absorbed and relieved by elastic deformation of the trough portion of the wave configurations, thus improving the shock absorbing properties.

Also, in this case as well, similar to the first and second embodiment, the longitudinal path length $L_1$ of the lower plate 3 in the forefoot portion F is longer the longitudinal path length $L_2$ of the upper plate 2 in the forefoot portion F.

Figure 8A:
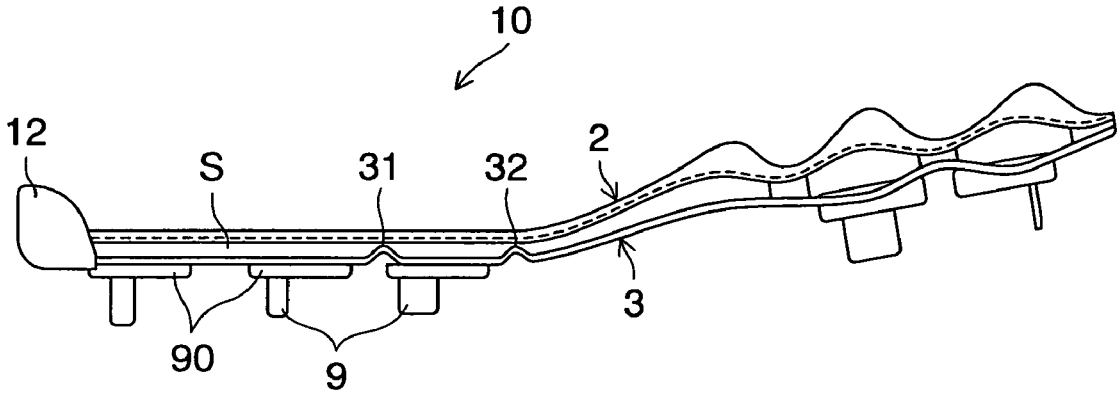
FIGS. 8A to 8C are side views each showing the bending state of a forefoot portion of the sole structure in turn according to the fourth embodiment of the present invention.
Figure 8B:
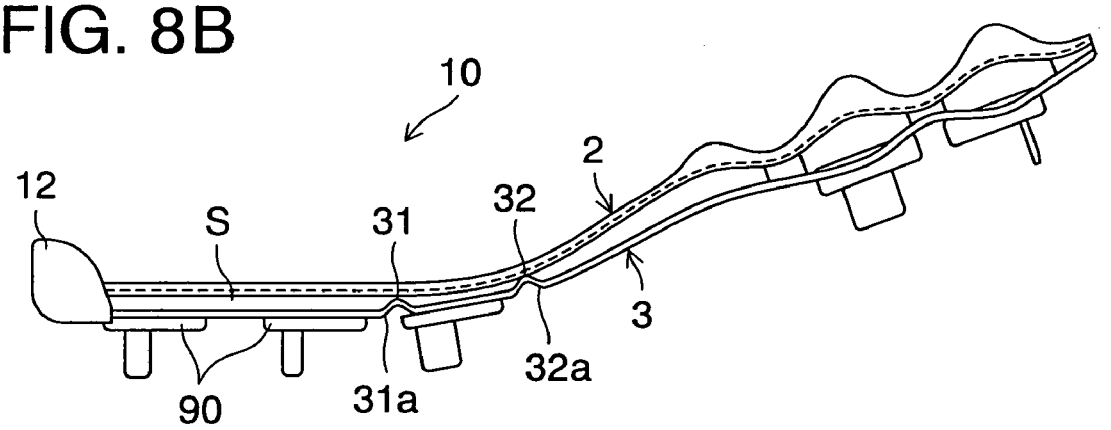
Figure 8C:
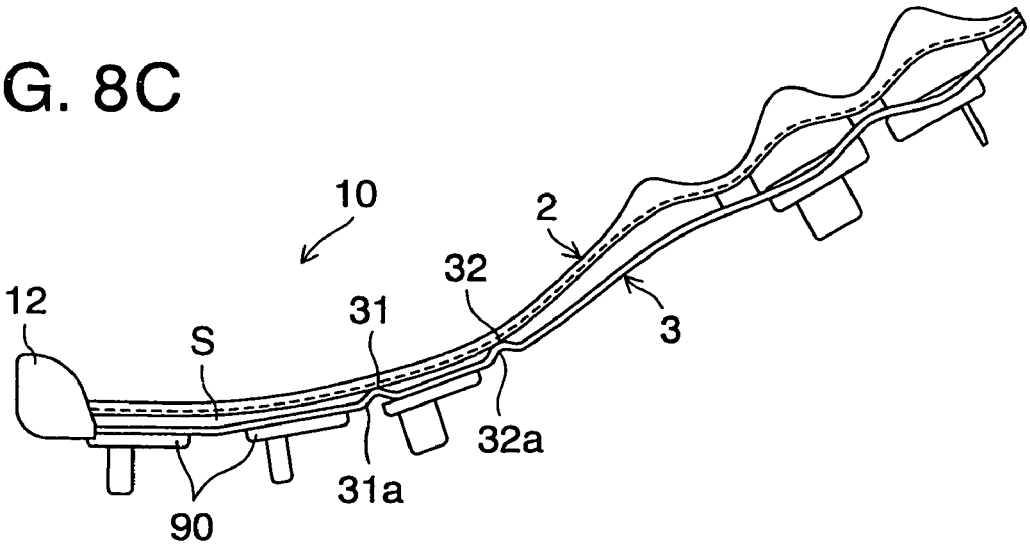

According to the above-mentioned sole structure 10, when the forefoot portion F of the sole structure 10 bends during walking or running of the shoe wearer, as shown in FIGS. 8A to 8C, the lower plate 3 elongates in the longitudinal direction in such a way that the convex portions 31, 32 of the lower plate 3 deforms into an extended or flatter shape in accordance with the bending degree of the forefoot portion F.

Thereby, in the process of the bending deformation of the forefoot portion F, the lower plate 3 does not hinder the bending deformation of the forefoot portion F, thus improving the bendability of the forefoot portion F. Also, in this case, since the grooves 31*a*, 32*a* are formed on the bottom surface of the lower plate 3, the lower plate 3 bends along these grooves 31*a*, 32*a*.

Moreover, in this case, because the upper plate 2 is provided with the void S formed relative to the lower plate 3, without being influenced by the bending state of the lower plate 3, which is also influenced by the thick mounting portion 90 that hardly bends, the upper plate 2 can be arcuately bent in a smooth manner during bending deformation of the forefoot portion F (see FIG. 8C). That can prevent the polygonal shaped bending of the lower plate 3 (i.e. bending points are between the adjacent mounting portions 90 and between the grooves 31*a* and 32*a*) from hindering the free bending of the foot of the shoe wearer. The foot contact feeling can also be improved. Furthermore, in this case, since a pressure from the cleats 9 at the time of landing on the ground is not directly transmitted to the upper plate 2, a pressure feeling imparted to the wearer's foot can be relieved.

Also, a cushion pad of a soft elastic material may be provided at a position corresponding to each of the cleats 9 in the void S between the upper and lower plate 2, 3. FIG. 7A shows a cushion pad 60 only as an example. In this case, a pressure exerted upwardly from the cleats 9 at the time of impacting onto the ground can be absorbed and relieved by the cushion pad.

In addition, a cushion pad may be provided at a position that does not correspond to each of the cleats 9 in the void S between the upper and lower plate 2, 3. Alternatively, a cushion pad may be formed of a cushion bar that extends laterally in the void S between the upper and lower plate 2, 3 through the position corresponding to each of the cleats 9. The cushion pad may have a lower elasticity, i.e. lower modulus of elasticity, than the upper and lower plate 2, 3. In such a manner, a cleated shoe suitable for baseball, soccer, golf, rugby or the like can be achieved.

Here, for comparison, a prior art sole structure for a cleated shoe is shown in FIGS. 9 to 12C. In these drawings, like reference numbers indicate identical or functionally similar elements.

Figure 9:
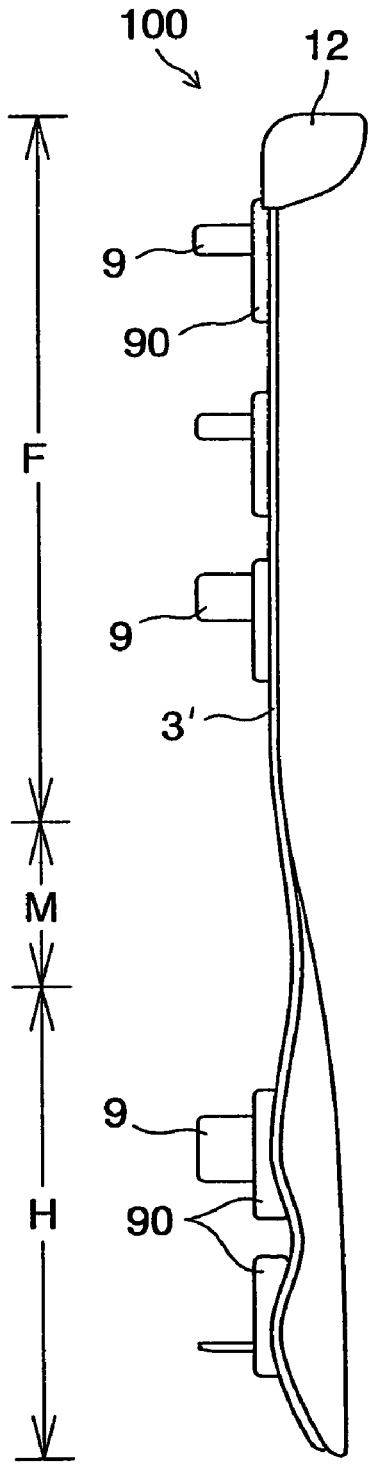
FIG. 9 PRIOR ART
FIG. 9 is a side view of an example of a prior art sole structure.
Figure 11:
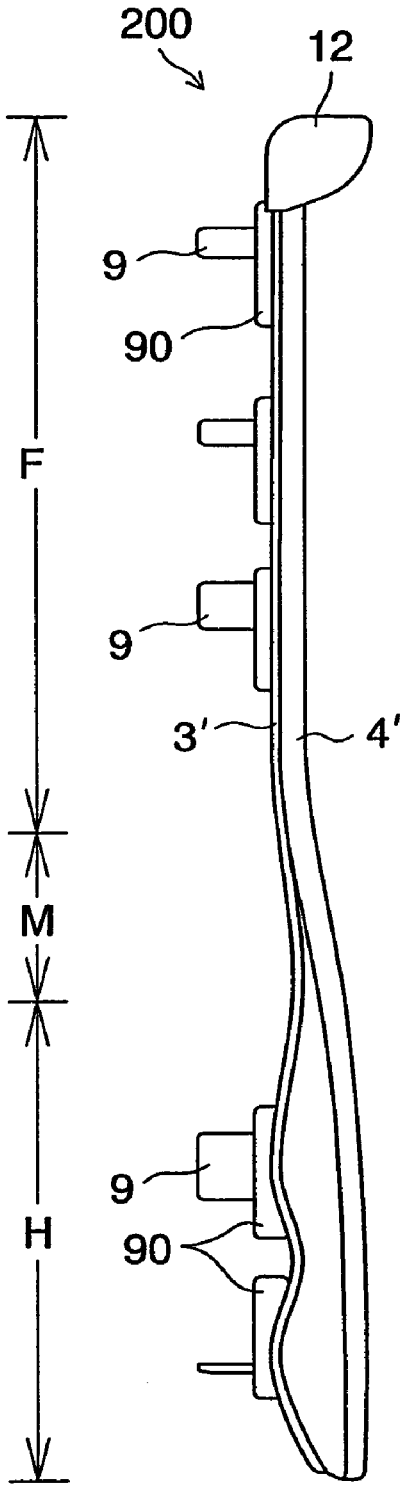
FIG. 11 PRIOR ART
FIG. 11 is a side view of another example of a prior art sole structure.

In each of a sole structure 100, 200 shown in FIGS. 9 and 11, there is not provided a member corresponding to the upper plate 2 of the present invention. There is provided an outsole plate 3' as a member corresponding to the lower plate 3, but the outsole plate 3' does not have portions corresponding to the convex portions 30, 31, and 32 of the present invention. The difference between the sole structure 100 and 200 is that in the sole structure 200 a midsole 4' is provided on the outsole plate 3'.

Figure 10A:
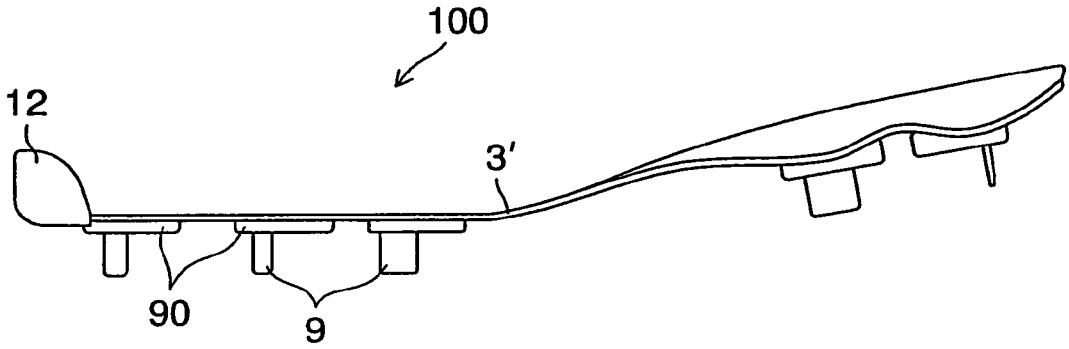
FIG. 10A PRIOR ART
FIGS. 10A to 10C are side views each showing the bending state of a forefoot portion of the prior art sole structure in FIG. 9 in turn.
Figure 10B:
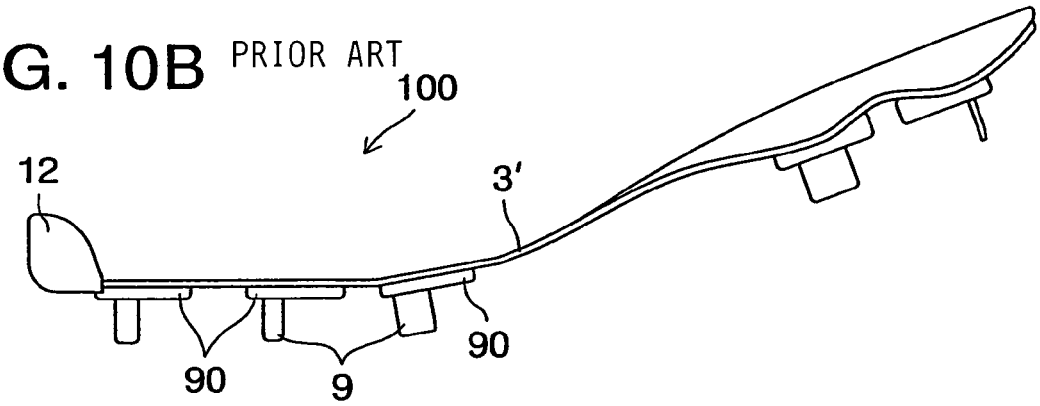
FIG. 10B PRIOR ART
Figure 10C:
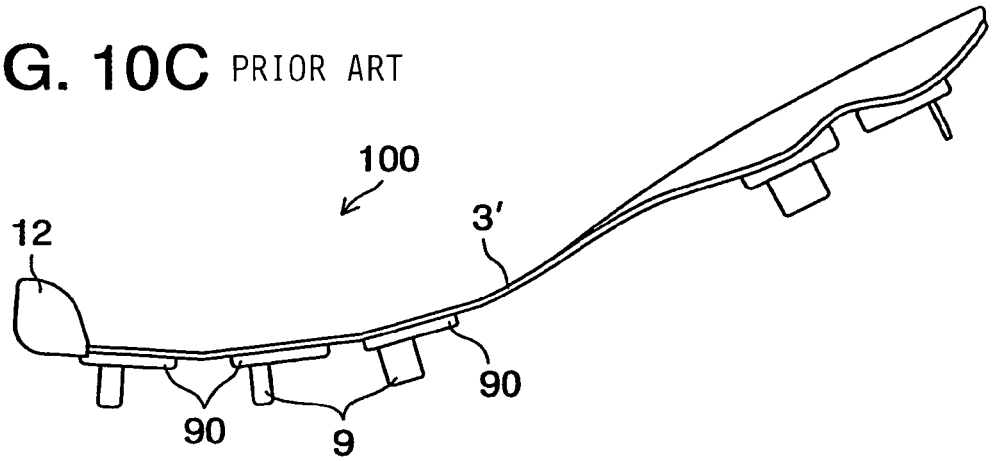
FIG. 10C PRIOR ART
Figure 12A:
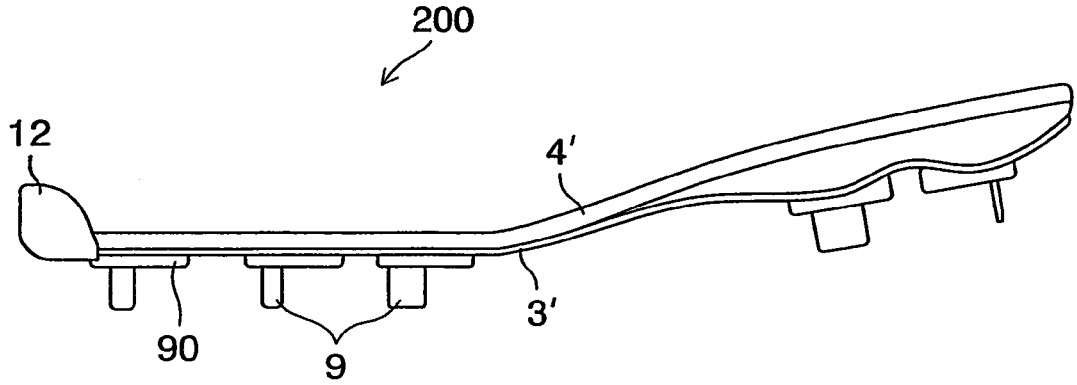
FIG. 12A PRIOR ART
FIGS. 12A to 12C are side views each showing the bending state of a forefoot portion of the prior art sole structure in FIG. 11 in turn.
Figure 12B:
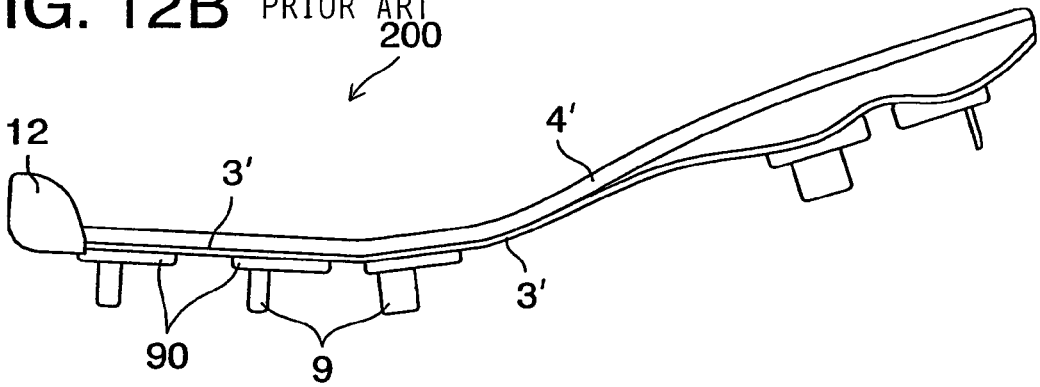
FIG. 12B PRIOR ART
Figure 12C:
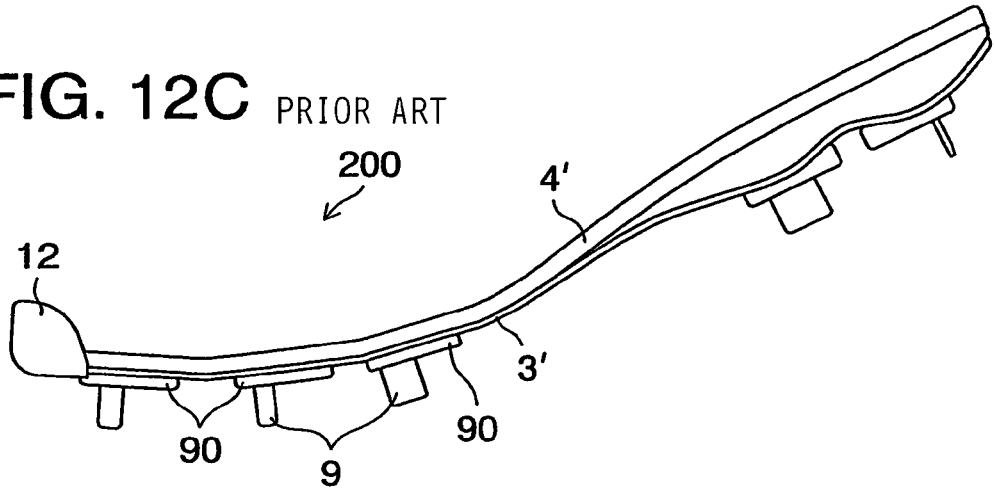
FIG. 12C PRIOR ART

When the forefoot portion F of the sole structure 100 bends, the outsole plate 3' deforms in a polygonal shape, as shown in FIGS. 10A to 10C, such that the outsole plate 3' bends at the position between the longitudinally adjacent mounting portions 90. Similarly, when the forefoot portion F of the sole structure 200 bends, the outsole plate 3' and the midsole 4' deforms in a polygonal shape, as shown in FIGS. 12A to 12C, such that the outsole plate 3' bends at the position between the longitudinally adjacent mounting portions 90. Such polygonal shaped bending hinders a free bending of a wearer's foot.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a shoe comprising:

an upper plate disposed on an upper side of a forefoot region of the sole structure; and a lower plate disposed on a lower side of the forefoot region of the sole structure and located away from the upper plate with a void formed therebetween;

wherein a longitudinal path length of the lower plate in the forefoot region of the sole structure is longer than a longitudinal path length of the upper plate in the forefoot region of the sole structure; and wherein the lower plate has at least one convex or concave portion that is elastically deformable into a flatter shape during bending of the forefoot region of the sole structure, such that thereby the lower plate elongates in a longitudinal direction of the sole structure during is bending of the forefoot region.

2. The sole structure according to claim 1, wherein a bottom surface of the lower plate directly constitutes a ground contact surface adapted to directly contact a ground surface under the sole structure.

3. The sole structure according to claim 1, wherein a front half portion of the forefoot region of the lower plate is at least mostly a smooth plate portion without any said convex or concave portion, and the forefoot region of the lower plate has the at least one convex or concave portion only on a portion thereof extending from a central region to a rearward region of the forefoot region.

4. The sole structure according to claim 1, wherein the at least one convex or concave portion extends uniformly and continuously in a lateral width direction across a width of the sole structure.

5. The sole structure according to claim 1, wherein the at least one convex or concave portion comprises plural upwardly protruding convex portions that each have a sectional shape of a trapezoid with an open bottom.

6. The sole structure according to claim 1, wherein the upper plate is generally flat in the forefoot region.

7. The sole structure according to claim 1, wherein the at least one convex or concave portion of the lower plate comprises a plurality of convex portions that protrude convexly toward the upper plate.

8. The sole structure according to claim 1, wherein the at least one convex or concave portion of the lower plate comprises a plurality of convex portions protruding convexly toward the upper plate and extending in the lateral direction, and the height of the convex portions on the medial side of the lower plate is greater than the height of the convex portions on the lateral side of the lower plate.

9. The sole structure according to claim 1, wherein the at least one convex or concave portion of the lower plate comprises a plurality of convex portions protruding convexly toward the upper plate and extending in the lateral direction, and the height of the convex portions on the lateral side of the lower plate is greater than the height of the convex portions on the medial side of the lower plate.

10. The sole structure according to claim 1, wherein the longitudinal path length of the lower plate in the forefoot region of the sole structure is at least 40% longer than the longitudinal path length of the upper plate in the forefoot region of the sole structure.

11. The sole structure according to claim 1, wherein the longitudinal path length of the lower plate in the forefoot region of the sole structure is 40-60% longer than the longitudinal path length of the upper plate in the forefoot region of the sole structure.

12. The sole structure according to claim 1, wherein the upper plate and the lower plate are formed of hard plastic material.

13. The sole structure according to claim 1, further comprising an outsole for contacting the ground disposed directly or via a midsole on a bottom surface of the lower plate.

14. The sole structure according to claim 13, wherein the outsole continuously covers the bottom surface of the forefoot region of the lower plate in the longitudinal direction.

15. The sole structure according to claim 13, wherein the midsole or the outsole has a laterally extending groove formed thereon.

16. The sole structure according to claim 1, further comprising one or more laterally extending cushion bars disposed between the upper plate and the lower plate in the void.

17. The sole structure according to claim 16, wherein the at least one convex or concave portion comprises plural upwardly protruding convex portions, and the one or more cushion bars comprise plural cushion bars that are each respectively positioned at locations between, in the longitudinal direction, successive ones of the upwardly protruding convex portions.

18. The sole structure according to claim 16, wherein the cushion bars interconnect the upper plate and the lower plate with one another, the upper plate and the lower plate each extend continuously in the longitudinal direction along the forefoot region and along a midfoot region and a heel region of the sole structure, the void is formed between the upper plate and the lower plate being spaced apart from one another continuously along the forefoot region, the midfoot region and the heel region, additional laterally extending cushion bars are arranged between and interconnect the upper plate and the lower plate in the midfoot region and the heel region, and the upper plate and the lower plate contact one another and are connected directly to one another only at a toe end and at a heel end of the upper and lower plates and otherwise the upper and lower plates are interconnected only by the cushion bars interposed therebetween.

19. The sole structure according to claim 18, wherein the lower plate has an upwardly curving portion in the midfoot region, and an upwardly curving portion longitudinally between two downwardly curving portions in the heel region, to form an undulating wavy sectional shape with the upwardly and downwardly curving portions in the midfoot region and the heel region, and the additional laterally extending cushion bars are positioned on the upwardly curving portions in the midfoot region and the heel region.

20. The sole structure according to claim 16, wherein each said cushion bar is respectively a member having a lower rigidity than the upper plate and the lower plate.

21. The sole structure according to claim 1, wherein the lower plate is formed with a longitudinally extending indentation, groove, recess, or elongated aperture.

22. The sole structure according to claim 1, wherein the upper plate is formed with a plurality of vent holes extending vertically through the upper plate.

23. The sole structure according to claim 1, further comprising a plurality of cleats on a bottom surface of the lower plate.

24. The sole structure according to claim 23, further comprising a cushion pad provided between the upper plate and the lower plate and disposed at a position corresponding to at least one of the cleats.

25. The sole structure according to claim 24, wherein the cushion pad extends in the lateral direction.

26. The sole structure according to claim 24, wherein the cushion pad is formed of a member of a lower rigidity than the upper plate and the lower plate.

27. The sole structure according to claim 23, further comprising a cushion pad provided between the upper plate and the lower plate and disposed at a position that does not correspond to one of the cleats.

28. The sole structure according to claim 27, wherein the cushion pad extends in the lateral direction.

29. The sole structure according to claim 27, wherein the cushion pad is formed of a member of a lower rigidity than the upper plate and the lower plate.

30. A sole structure for a shoe comprising:

an upper plate extending in a lateral width direction and a longitudinal direction in at least a forefoot region of the sole structure;

a lower plate arranged below the upper plate and spaced apart from the upper plate to form a void therebetween, and extending in the lateral width direction and the longitudinal direction in at least the forefoot region; and cushion bars that extend in the lateral width direction and that are arranged in the void between, and interconnect, the upper plate and the lower plate;

wherein a rear portion of the forefoot region of the lower plate has upwardly deflected undulations that each respectively form a concave groove in a bottom side of the lower plate and a convex protruding ridge on a top side of the lower plate, and that each respectively extend along the lateral width direction;

wherein a longitudinal path length along a contour of the lower plate in the forefoot region of the sole structure is longer than a longitudinal path length along a contour of the upper plate in the forefoot region of the sole structure; and wherein the upwardly deflected undulations of the lower plate are elastically deformable into a flatter shape while elongating the lower plate in the longitudinal direction during bending of the forefoot region of the sole structure.

31. The sole structure according to claim 30, wherein a front portion of the forefoot region of the lower plate is a smooth plate portion without any convex or concave undulations.

32. The sole structure according to claim 30, wherein the cushion bars are each respectively positioned at locations between, in the longitudinal direction, successive ones of the upwardly deflected undulations.

* * * * *